United States Patent [19]

Horie et al.

[11] 4,056,396

[45] Nov. 1, 1977

[54] LAYERS USED TO PREVENT RETICULATION IN PHOTOGRAPHIC ELEMENTS

[75] Inventors: Ikutaro Horie; Takushi Miyazako; Shinji Sakaguchi; Nobuo Tsuji; Nagao Kameji, all of Ashigara, Japan

[73] Assignee: Fuji Photo Film Co., Ltd., Minami-ashigara, Japan

[21] Appl. No.: 578,069

[22] Filed: May 16, 1975

Related U.S. Application Data

[63] Continuation-in-part of Ser. No. 441,781, Feb. 12, 1974, abandoned.

[30] Foreign Application Priority Data

Feb. 12, 1973 Japan ..... 48-17273

[51] Int. Cl.[2] ..... G03C 1/76; G03C 3/00

[52] U.S. Cl. ..... 96/67; 96/50 PL; 96/87 R

[58] Field of Search ..... 96/50 PL, 67, 114, 87 R, 96/85

[56] References Cited

U.S. PATENT DOCUMENTS

| | | | |
|---|---|---|---|
| 2,306,071 | 12/1942 | McNally et al. | 96/87 R |
| 2,391,181 | 12/1945 | Minsk et al. | 96/50 PL |
| 2,751,315 | 6/1956 | Staehle | 96/50 PL |
| 2,835,582 | 5/1958 | Fowler et al. | 96/114 |
| 3,502,501 | 3/1970 | Burczyk et al. | 96/87 R |
| 3,512,985 | 5/1970 | Harvey | 96/114 |
| 3,591,379 | 7/1971 | Plakunov | 96/67 |
| 3,655,407 | 4/1972 | McGraw | 96/114 |
| 3,877,947 | 4/1975 | Tsuji et al. | 96/67 |
| 3,895,949 | 7/1975 | Akamatsu et al. | 96/87 R |

FOREIGN PATENT DOCUMENTS

| | | | |
|---|---|---|---|
| 752,791 | 7/1956 | United Kingdom | 96/50 PL |

*Primary Examiner*—Jack P. Brammer
*Attorney, Agent, or Firm*—Sughrue, Rothwell, Mion, Zinn and Macpeak

[57] ABSTRACT

A photographic light-sensitive material including a support, a non-light sensitive uppermost layer consisting of at least one organic synthetic high polymer compound as a film forming material and at least one light-sensitive layer between the support and the uppermost layer, said organic high polymer compound being selected from the group consisting of the following polymers (A) to (F):

polymer (A) comprising repeating units $a_1$ and $a_2$;

| | | |
|---|---|---|
| $a_1$: | $-CH_2CH-$ <br> \| <br> $OH$ | 80 - 97 mol% |
| $a_2$: | $-CH_2CH-$ <br> \| <br> $O(CH_2)_mSO_3M$ | 3 - 20 mol% |

wherein M represents a cation, and $m$ represents 0, 3 or 4;

polymer (B) comprising repeating units $b_1$, $b_2$ and $b_3$;

| | | |
|---|---|---|
| $b_1$: | $-CH_2CH-$ <br> \| <br> $CON{<}^{R_1}_{R_2}$ | 5 - 30 mol% |
| $b_2$: | $R_3$ <br> \| <br> $-CH_2C-$ <br> \| <br> $COOR_4$ | 5 - 75 mol% |
| $b_3$: | $R_5$ <br> \| <br> $-CH_2C-$ <br> \| <br> $CONH_2$ | 20 - 65 mol% |

wherein $R_1$ and $R_2$ each represents $-CH_3$ or $-C_2H_5$, $R_3$ and $R_5$ each represents —H or $-CH_3$, and $R_4$ represents $-CH_3$, $-C_2H_5$, $-C_3H_7$ or $-C_4H_9$;

polymer (C) comprising repeating units $c_1$ and $c_2$;

| | | |
|---|---|---|
| $c_1$: | $-CH_2CH-$ <br> \| <br> $CO$ <br> \| <br> $NH$ <br> \| <br> $CH_3-C-CH_3$ <br> \| <br> $CH_2$ <br> \| <br> $CHOH$ <br> \| <br> $CH_3$ | 10 - 40 mol% |
| $c_2$: | $R_6$ <br> \| <br> $-CH_2C-$ <br> \| <br> $Z$ | 60 - 90 mol% |

wherein $R_6$ represents —H or $-CH_3$, and Z represents $-COOH$, $-COOCH_3$, $-COOC_2H_5$, $-COOC_3H_7$, $-COOC_4H_9$ or $-CONH_2$;

polymer (D) comprising repeating units $d_1$ and $d_2$;

| | | |
|---|---|---|
| $d_1$: | $-CH_2CH-$ <br> \| <br> $CO$ <br> \| <br> $NH$ <br> \| <br> $CH_3-C-CH_3$ <br> \| <br> $CH_2$ <br> \| <br> $CO$ <br> \| <br> $CH_3$ | 10 - 40 mol% |
| $d_2$: | $R_7$ <br> \| <br> $-CH_2C-$ <br> \| <br> $CONH_2$ | 60 - 90 mol% |

wherein $R_7$ represents —H or $-CH_3$;

polymer (E) comprising repeating units $e_1$ and $e_2$;

| | | |
|---|---|---|
| $e_1$: | $-CH_2C(R_8)(COOX)-$ | 20 - 60 mol% |
| $e_2$: | $-CH_2C(R_9)(COOH)-$ | 40 - 80 mol% |

wherein $R_8$ and $R_9$ each represents —H or $—CH_3$, and X represents $—CH_3$, $—C_2H_5$, $—C_3H_7$ or $—C_4H_9$; and polymer (F) comprising repeating unit $f_1$;

$f_1$: $-CH_2CH(OY)CH(OC(=O)HO)CH(CO)OR_{10}$ wherein Y represents $—CH_3$ or $—COCH_3$, $R_{10}$ represents —H or $—C_nH_{2n+1}$, $n$ being an integer of 1 to 12, said organic synthetic high polymer compound being insoluble to a processing solutions during processing.

10 Claims, No Drawings

LAYERS USED TO PREVENT RETICULATION IN PHOTOGRAPHIC ELEMENTS

CROSS REFERENCE TO RELATED APPLICATION

This application is a continuation-in-part of U.S. application Ser. No. 441,781, filed Feb. 12, 1974, now abandoned by Horie et al. and entitled "Photographic Light-Sensitive Material".

BACKGROUND OF THE INVENTION

1. Field of the Invention

The present invention relates to a photographic light-sensitve material and, more particularly, it relates to a photographic light-sensitive material in which formation of reticulation is prevented.

2. Description of the Prior Art

In order to increase the rate of producing photographic light-sensitive materials, the drying rate must be increased. To increase the drying rate, drying is conducted at an elevated temperature. However, the drying rate is limited since reticulation occurs at a temperature above a certain limit, generally 30° C or more.

Also, exposed light-sensitive materials are processed at an elevated temperature to increase the rate of processings such as development, fixation, bleacing and washing. However, the processing temperature is also limited since reticulation occurs at a temperature above a certain limit.

In general, hardeners such as those described in C. E. K. Mees and T. H. James *The Theory of the Photographic Process,* 3rd. edition pp. 54–60, The Macmillan Co., New York, are added either to the photographic light-sensitive materials or to the processing solutions to prevent reticulation during processing. However, these methods have the defect that the addition of the hardener in a sufficient amount to prevent reticulation with conventional prior art materials often affects the photographic emulsion and retards the processing rate.

Therefore, a photographic light-sensitive material which is not subject to reticulation upon production and on processing thereof at an elevated temperature has been desired.

As one means to solve this problem, it is known to coat carboxymethylated casein or ethyl cellulose sulfate sodium salt on the uppermost layer of a photographic light-sensitive material. However, since carboxymethylated casein is prepared from a natural product, it has the devects that a product with uniform characteristics is difficult to obtain, that it possesses poor coating properties, and that it is difficult to remove impurities exerting detrimental influences on the photographic properties from this product. Also, with sodium salt of ethyl cellulose sulfate, it is difficult to obtain a water-solube product by converting ethyl cellulose to the sodium sulfate salt thereof. This is because the solubility properties obtained greatly depend upon the degree of ethylation and the degree of polymerization of the ethyl cellulose starting material. In order to obtain a sodium salt of ethyl cellulose sulfate product having a good solubility, the degree of ethylation and the degree of polymerization of ethyl cellulose is limited to an extremely narrow range. It is difficult to obtain such an ethyl cellulose with a good reproducibility. Ethyl cellulose is essentially poor in solubility. Therefore, when it is completely converted to the sodium sulfate salt, it becomes difficult to handle, i.e., it becomes insoluble in either water or organic solvents such as alcohol or acetone, which makes coating difficult. In addition, it is known that sulfuric acid esters in general have poor stability.

U.S. Pat. No. 3,835,582 Fowler, Jr., et al. discloses polymers (B) and (E) of the present invention. However, polymers (B) and (E) are always used in admixture with gelatin when the same are utilized as an uppermost non-light-sensitive layer in a photographic element. Fowler, Jr., et al. further do not disclose that the copolymers prevent reticulation. Typically, Fowler, Jr., et al. use a 1:1 gelatin-polymer coating solution (see, for examples, Col. 5, lines 25–28) whereas we, the inventors of the present application, have found that if a 1:4 gelatin-polymer coating solution is utilized reticulation cannot be prevented, as shown in Example 5 of the present application.

U.S. Pat. No. 3,655,407 McGraw discloses a copolymer utilized for thickening an aqueous composition of a hydrophilic colloid such as gelatin. The copolymer is present in the compositions disclosed in the McGraw patent in an amount of only 0.1 to 5% by weight of the hydrophilic colloid, however.

U.S. Pat. No. 3,512,985 Harvey discloses the utilization of a polymer as a binder for a photographic silver halide emulsion; the emulsion always contains a hydrophilic colloid, such as gelatin.

U.S. Pat. No. 2,391,181 Minsk et al discloses polymer (E) of the present invention. However, there are important differences between the invention described in the Minck et al. patent and the present invention. Firstly, the polymers used in Minsk et al must be soluble in an alkaline photographic developing solution so that development can take place in a conventional manner (see, Col. 1, lines 43–48). Secondarly, the polymers in the Minsk et al. patent are used only to protect an emulsion against the action of water and hypo in a negative during conventional contact printing. In the present invention, the uppermost layer is not soluble in alkaline developing solutions because it is used to protect the light-sensitive layer from the processing solution.

British Pat. No. 752,791 discloses the provision of a polymer layer on an emulsion layer containing a photographic image, i.e., the polymer layer is provided after emulsion has been processed. In such processing, the problem of reticulation does not occur.

U.S. Pat. No. 2,957,767 Williams discloses silver halide dispersions containing a polymer.

U.S. Pat. No. 3,608,465 Ching et al. discloses an emulsion layer covered by a film which imbibes processing solution; the film covers a photographic product after the film has been separated from the emulsion layer.

U.S. Pat. No. 3,218,298 Piganoil discloses a method for producing polymers.

SUMMARY OF THE INVENTION

As a result of extensive investigations to develop a method eliminating these defects which are suitable for practical use, the inventors have successfully prevented the formation of reticulation upon production of a light-sensitive material or during the processing thereof by providing a layer of one or more of the following organic synthetic high polymer compounds as the non-light-sensitive uppermost layer of the light-sensitive material, which light-sensitive material includes at least one separate light-sensitive layer disposed between said non-light-sensitive layer and a support.

The synthetic high polymer compounds used in the present invention are those represented by the following Polymers (A) to (F) or mixtures of two or more thereof:

Polymer (A): comprising the repeating units $a_1$ and $a_2$;

| | |
|---|---|
| $a_1$: $-CH_2CH-$ (OH) | 80 - 97 mol% |
| $a_2$: $-CH_2CH-$ ($O(CH_2)_mSO_3M$) | 3 - 20 mol% |

wherein M represents a hydrogen atom or a cation such as $NH_4$, Na, K, Li, etc. and $m$ represents 0, 3 or 4;

Polymer (B): comprising the following repeated units $b_1$, $b_2$ and $b_3$;

| | |
|---|---|
| $b_1$: $-CH_2CH-$ ($CON{<}^{R_1}_{R_2}$) | 5 - 30 mol% |
| $b_2$: $-CH_2C(R_3)-$ ($COOR_4$) | 5 - 75 mol% |
| $b_3$: $-CH_2C(R_5)-$ ($CONH_2$) | 20 - 65 mol% |

wherein $R_1$ and $R_2$ each represents $-CH_3$ or $-C_2H_5$, $R_3$ and $R_5$ each represents —H or $-CH_3$, and $R_4$ represents $-CH_3$, $-C_2H_5$, $-C_3H_7$ or $-C_4H_9$;

Polymer (C): comprising the following repeating units $c_1$ and $c_2$;

| | |
|---|---|
| $c_1$: $-CH_2CH-(CO-NH-C(CH_3)_2-CH_2-CHOH-CH_3)$ | 10 - 40 mol% |
| $c_2$: $-CH_2C(R_6)-$ (Z) | 60 - 90 mol% |

wherein $R_6$ represents —H or $-CH_3$, Z represents $-COOH$, $-COOCH_3$, $-COOC_2H_5$, $-COOC_3H_7$, $-COOC_4H_9$, or $-CONH_2$;

Polymer (D): comprising the following repeating units $d_1$ and $d_2$;

| | |
|---|---|
| $d_1$: $-CH_2CH-(CO-NH-C(CH_3)_2-CH_2-CO-CH_3)$ | 10 - 40 mol% |
| $d_2$: $-CH_2C(R_7)-$ ($CONH_2$) | 60 - 90 mol% |

wherein $R_7$ represents —H or $-CH_3$;

Polymer (E): comprising the following repeating units $e_1$ and $e_2$;

| | |
|---|---|
| $e_1$: $-CH_2C(R_8)-$ (COOX) | 20 - 60 mol% |
| $e_2$: $-CH_2C(R_9)-$ (COOH) | 40 - 80 mol% |

wherein $R_8$ and $R_9$ each represents —H or $-CH_3$, and X represents $-CH_3$, $-C_2H_5$, $-C_3H_7$, or $-C_4H_9$; or Polymer (F): comprising the following repeating unit $f_1$;

| | |
|---|---|
| $f_1$: $-CH_2CH(OY)CH(OC(HO))CH(CO(OR_{10}))$ | |

wherein Y represents $-CH_3$ or $-COCH_3$, $R_{10}$ represents —H or $-C_nH_{2n+1}$, $n$ being 1 to 12. The synthetic high polumer compounds are insoluble in processing solutions during processing.

Polymers (A)-(D) and (F) provide results superior to polymer (E), though all of polymers (A)-(F) are superior to known prior art polymers as an uppermost light-sensitive layer.

DETAILED DESCRIPTION OF THE INVENTION

Suitable synthetic high molecular compounds which can be used in the invention are those which have a degree of polymerization of about 100 to 30,000, preferably 100 to 5,000, for Polymers (A) to (E) and, for Polymer (F), those which have a degree of polymerization of about 100 to 20,000, preferably 100 to 5,000.

The excellent results in preventing reticulation can be obtained using copolymers which have a mol % as disclosed above. In addition, such copolymers can be obtained easily from an industrial viewpoint, and can be processed without problems in the present invention.

The uppermost layer of the present invention consists of one or more of the above polymers (A)-(F), i.e., it contains substantially 100% of one or more of the polymers described above as the film forming component. If the layer contains gelatin, it becomes increasingly difficult to prevent reticulation as the amount of gelatin increases.

The preparation of th polymers of the invention can be using conventional techniques well knonw to one skilled in the art.

In general, Polymer A can be prepared by alkylsulfonation of polyvinyl alcohol (e.g., as disclosed in *Makromol Chemie,* Vol. 116, page 152 (1968)), and Polymers B to E can be prepared by polymerization of each of the monomers, and Polymer F can be prepared by alcoholysis of the parent polymers.

If the polymer is soluble in a processing solution with which the photographic material is processed, the polymer should be hardened by a hardener to render the same insoluble in the processing solution.

Specific examples of polymers which can be used in the present invention and synthesis examples thereof are described below. Unless otherwise indicated hereinafter, all parts, percents, ratios and the like are by weight.

Polymer 1

In a 1-liter round bottom flask equipped with a thermometer and a stirring device were placed 44g of polyvinyl alcohol (Gohsenol NL-05, trade name produced by Nippon Synthetic Chemical Ind. Co., Ltd., mol. wt. about 500), 27.6 g of potassium carbonate, 500 ml of dimethylsulfoxide and 48.8 g of propanesultone and the system was stirred at 85° C for 15 hours. The reaction product was poured into an excess of acetone and, after removing the diethylsulfoxide, the product ws vacuum dried at 50° C. Sulfur analysis of the thus obtained product showed that 21.2 mol % of the sulfopropyl group was introduced into the polymer.

Polymer 2

In a 1-liter round bottom flask equipped with a thermometer and a stirring device were placed 44 g of polyvinyl alcohol (Gohsenol NM-11, mol. wt. about 1100), 1.38 g of potassium carbonate, 500 ml of dimethylsulfoxide and 24.4 g of propanesultone and stirred at 85° C for 15 hours. The reaction product was poured into an excess amount of acetone and, after removing the dimethylsulfoxide, the product was vacuum dried at 50° C. Sulfur analysis of the thus obtained product showed that it contained 9.4 mol % of the sulfopropyl group.

Polymer 3

In a 1-liter round bottom flask equipped with a thermometer and a stirring device were placed 44 g of polyvinyl alcohol (Gohsenol NH.-18; mol. wt. about 1800), 6.9 g of potassium carbonate, 500 ml of dimethylsulfoxide and 12.2 g of propanesultone and stirred at 85° C for 15 hours. The reaction product was poured into an excess amount of ethanol and, after removing the dimethylsulfoxide, the product was vacuum dried at 50° C. Sulfur analysis showed that 4.1 mol % of the sulfopropyl group was introduced into the polymer.

Polymer 4

In a 2-liter round bottom flask were blaced 50.8 g of N,N-diethylacrylamide, 34.2 g of methyl acrylate, 85.2 g of acrylamide, 800 ml of water, 20 ml of isopropanol and, as a polymerization catalyst, 800 mg of potassium persulfate. After replacing the atmosphere with nitrogen, the reaction was conducted at 70°-80° C for 3 hours. The reaction product was placed in a cellophane membrane tube and was subjected to dialysis in running water overnight followed by lyophilization. Yield: 153.9 g (90.5%). The intrinsic viscosity thereof as measured at 30° C in water containing 20 volume % of ethanol was 1.08.

Polymer 5

In a 1-liter round bottom flask equipped with a thermometer and a stirring device were placed 51.6 g of methacrylic acid, 68.4 g of N-(1,1-dimethyl-3-hydroxybutyl)acrylamide, 150 ml of water, 150 ml of ethanol and, as a polymerization catalyst, 500 mg of potassium persulfate. After replacing the atmosphere with nitrogen, the reaction was conducted at 70°-75° C for 4 hours. The reaction product was placed in a cellophane membrane tube and was subjected to dialysis in running water overnight followed by lyophilization. Yield: 104.0 g (86.7%). The intrinsic viscosity thereof measured at 30° C in water containing 50 volume % of ethanol was 0.66.

Polymer 6

In a 1-liter round bottom flask equipped with a thermometer and a stirring device were placed 42.6 g of acrylamide, 68.4 g of N-(1,1-dimethyl-3-hydroxybutyl-)acrylamide, 150 ml of water, 150 ml of ethanol and, as a polymerization catalyst, 500 mg of potassium persulfate. After replacing the atmosphere with nitrogen, the reaction was conducted at 70°-75° C for 4 hours. The reaction product was placed in a cellophane membrane tube and subjected to dialysis in running water overnight followed by lyophilization. Yield: 9.26 g (82.5%). The intrinsic viscosity thereof measured at 30° C in water was 0.59.

Polymer 7

In a 1-liter three-necked flask were placed 70.42 g of N-(1,1-dimethyl-3-hydroxybutyl)-acrylamide and 29.58 g of acrylamide. Then, 150 ml of water and 240 ml of ethanol were added thereto to dissolve. Afteradding thereto 40 ml of isopropanol, the temperature was increased to 60° C. The atmosphere inside the flask was replaced with nitrogen, gas, and an aqueous solution prepared by dissolving 1.12 g of potassium persulfate and 433 mg of sodium hydrogen sulfite in 50 ml of water was added thereto. After stirring the mixture for 4 hours while maintaining the temperature at 60° C, the reaction solution was placed in a cellophane tube and was subjected to dialysis in running water for 48 hours followed by lyophilization. Yield: 88 g; Elemental Analysis: H 8.16%; C 55.3%; N 10.7%. The intrinsic viscosity of the product in ethanol (30° C) was 0.205.

Polymer 8

In a 500 ml three-necked flask were placed 24.62 g of butyl acrylate and 55.38 g of acrylic acid, and 200 ml of ethanol was added thereto. After replacing the atmosphere with nitrogen, the temperature was increased to 70° C. Then, 1.16 g of benzoyl peroxide, dissolved in 40 ml of ethanol, was added to the flask. Stirring was conducted for 7 hours while maintaining the temperature at 70° C. The reaction solution was placed in a cellophane tube and was subjected to dialysis in running water for 2 days, followed by lyophilization. Yield: 71.3 g. The content of acrylic acid in the resulting copolymer was 73.2 mol %. The intrinsic viscosity of the polymer measured in ethanol at 30° C was 0.375.

Polymer 9

A 1-liter three-necked flask, equipped with a stirring device, a thermometer and a reflux condenser, was placed on a steam bath. In this flask was placed 150 g of methyl vinyl ether-maleic anhydride copolymer (GANTREZ AN, trade name made by GAF Co.; mol wt about 10,000–20,000; mol ratio 50:50). Then, 500 ml of methanol was injected thereinto. Stirring was conducted for 8 hours while maintaining the temperature at the boiling point of methanol for refluxing. The reaction product was then poured into an excess amount of diethyl ether-n-hexane mixture (1:1 by volume). The resulting precipitate was vacuum dried. The intrinsic viscosity measured in methanol at 30° C was 0.71.

Polymer 10

150 Grams of vinyl acetate-maleic anhydride copolymer as described in Polymer 9 and 500 ml of butanol were reacted with each other in the same manner as described for Polymer 9. The intrinsic viscosity of the resulting polymer measured in ethanol at 30° C was 0.57.

Polymer 11

17.9 g (0.1 mol) of diacetonacrylamide, 63.9 g (0.9 g mol) of acrylamide, 500 ml of water, 10 ml of isopropyl alcohol and 800 mg of potassium persulfate as a polymerization initiator were charged into a 1-liter reaction vessel. The air in the vessel was replaced with nitrogen and the reaction mixture was stirred at 80° C for 5 hours. The reaction product was then freeze-dried. The yield was 78.4 g (95.8%). The intrinsic viscosity of the resulting polymer measured in ethanol at 30° C was 0.69.

The synthetic polymer compounds used in the present invention can be used alone or as a combination of two or more thereof. These polymer compounds can be applied to form the uppermost layer of a photographic light-sensitive material as an aqueous solution, an organic solvent solution (e.g., using methanol, ethanol, isopropanol, butanol, N,N-dimethylformamide, acetone, dimethylsulfoxide, etc.) or a water-organic solvent solution (using a water:organic solvent ratio of about 95:5 to 5:95 by volume). A suitable solution concentration ranges from about 1 to 15% by weight.

Such a polymer solution may contain additionally, if desired, a hardener, an adhesion-preventing agent, an anti-slip agent, a slip agent, an antistatic agent, a coating aid, a matting agent, and the like. Hardeners are well known in the art and suitable examples are disclosed in C. E. K. Mees and T. H. James, *The Theory of the Photographic Process,* 3rd. Ed. pages 55–60 (1966), The Mcmillan Co., New York; U.S. Pat. Nos. 3,316,095; 3,232,764; 3,288,775; 2,732,303; 3,635,718; 3,232,763; 2,732,316; 2,586,168; 3,103,437; 3,017,280; 2,983,611; 2,725,294; 2,725,295; 3,100,704; 3,091,537; 3,321,313; and 3,543,292; and British Pat. Nos. 974,723; 994,869; 1,167,027.

Typical examples of such hardeners are dimethylolurea, trimethylolmelamine, 1,3-bis[(diallylamino)-methyl]urea, 1,3-bis(piperidinomethyl) urea, 2,3-dihydroxy-1,4-dioxane, 2,3-dihydroxy-5-methyl-1,4-dioxane and 2,5-dimethoxy-tetrahydrofuran, aldehyde compounds such as mucochloric acid, mucobromic acid, mucophenoxychloric acid, mucophenoxybromic acid, formaldehyde, dimethylolurea, trimethylomelamine, 1,3-bis[(diallylamino)methyl]urea, 1,3-bis(-piperidinomethyl) urea, glyoxal, monomethylgyloxal, 2,3-dihydroxy-1,4-dioxane, 2,3-dihydroxy-5-methyl-1,4-dioxane, succinaldehyde and 2,5-dimethoxy-tetrahydrofuran, and glutaraldehyde, active vinyl compounds such as divinyl sulfone, methylenebismaleimide, 5-acetyl-1,3-diacryloyl-hexahydro-S-triazine, 1,3,5-triacryloyl-hexahydro-S-triazine and 1,3,5-trivinylsulfonyl-hexahydro-S-triazine; active halogenides such as the sodium salt of 2,4-dichloro-6-hydroxy-S-triazine, 2,4-dichloro-6-methoxy-S-triazine, the sodium salt of 2,4-dichloro-6-(4-sulfoanilino)-S-triazine, 2,4-dichloro-6-(2-sulfoethylamine-S-triazine and N,N'-bis(2-chloroethylcarbamyl)-piperadine; epoxy compounds such as the p-toluenesulfonic acid salt of bis(2,3-epoxypropyl)methylpropylammonium, 1,4-bis(2',3'-epoxypropyloxybutane), 1,3,5-triglycidylisocyanurate, and 1,3-diglycidyl-5-($\gamma$-acetoxy-$\alpha$-oxypropyl)isocyanurate; ethyleneimine compounds such as 2,4,6-triethyleneimino-S-triazine, 1,6-hexamethylene-N,N-bisethyleneurea, and bis-$\beta$-ethyleneiminoether; methanesulfonic acid ester compounds such as 1,2-di(methanesulfoneoxy)-ethane, 1,4-di(methanesulfoneoxy)butane, and 1,5-di(methanesulfoneoxy)-pentane; carbodiimide compounds such as the hydrochloric acid salt of 1-ethyl-3-(3-dimethylaminopropyl)carbodiimide, the perchloric acid salt of 2,5-dimethylisoxazole, 2-ethyl-5-phenylisoxazol-3'-sulfonate, and 5,5'-(p-phenylene)bisisoxazole; inorganic compounds such as chromium alum and chromium acetate, and the like.

The amount of hardener used to render the polymer isoluble in an alkaline developing solution during processing depends on the monomer used to provide the polymer, the degree of polymerization of the polymer and the hardener to be used. It is preferred that the amount of the hardener be in the range of 0.1–10 weight percent based on the polymer weight. A most preferred range is 0.5–5 weight percent.

Examples of adhesion preventing agents, anti-slip agents and matting agents are silica, magnesium oxide, titanium dioxide, calcium carbonate, polymethyl methacrylate, cellulose acetate propionate, etc.

Examples of anti-friction agents are polyhydric alcohols, glycerin, and polysilicones.

Suitable examples of antistatic agents which can be used are disclosed in U.S. Pat. No. 3,658,573, and German Patent (OLS) No. 2,162,804 and (OLS) No. 2,211,813.

Illustrative of the coating aids which can be used are saponin, alkyl benzene sulfonates, alkyl sulfates; the anionic surfactants as described in U.S. Pat. Nos. 3,026,202; 3,415,649; and 3,666,478; the amphoteric surfactants as described in U.S. Pat. No. 3,233,816; British Pat. No. 1,164,095, and the nonionic surfactants as described in U.S. Pat. No. 3,514,293; British Pat. No. 1,012,495; and Japanese Patent Publication No. 22659/69.

The polymer solution can be applied thereto using any conventional technique. Suitable examples of coating methods which can be used are, e.g., dip coating, air-knife coating, curtain coating, extrusion coating, slide coating, and the like. Of course, this uppermost layer can be applied together with one or more other layers at the same time. The thickness of the layers should be sufficient to prevent reticulation. A suitable layer thickness ranges from about 0.5 to 3$\mu$, more preferably from about 1 to 2$\mu$.

The layer comprising the synthetic polymer compound of the present invention can be applied as an uppermost layer to any kind of photographic material. In the photographic material of the present invention, all of known elements employed in photographic materials can be used with the uppermost layer of the element consisting of the synthetic polymer compound(s) of the present invention. The images formed using the photographic material of the present invention can comprise either silver images or organic dye images.

The photographic material of this invention can be used in, e.g., black and white photographic elements, X-ray photographic elements, color negative photographic elements, color positive photographic elements, color paper photographic elements, color reversal photographic elements, examples of which are well known in the art as disclosed in U.S. Pat. Nos. 3,582,322; 3,622,318; 3,547,640; 3,672,898; 3,516,832; 3,715,208; 3,737,312; 3,705,803; 3,705,799; 3,703,375; 3,379,529; 3,639,417; 3,402,046; 3,450,536; and 3,545,971; and British Pat. No. 923,045; and U.S. pat. application Ser. No. 206,060, filed Dec. 8, 1971 now U.S. Pat. No. 3,811,890 and Ser. No. 29,666, filed Apr. 17, 1970 now U.S. Pat. No. 3,657,149.

One embodiment of the light-sensitive photographic material of the present invention comprises a support, a silver halide light-sensitive emulsion and an uppermost layer consisting of the synthetic polymer compound of the present invention.

mol %, 2.2 g/m² of Ag) containing 45 g/100 g of silver of 4-methoxy-2'-chloro-5'-{2-(2,4-di-tert-pentylphenoxy)butylamido}benzoylacetanilide as a yellow color-forming coupler, 0.8 g/100 g of gelatin of 5-hydroxy-7-methyl-1,3,8-triazaindolizine, a 5 g/100 g of gelatin of 2-hydroxy-4,6-dichloro-S-triazine sodium salt and 1 g/100 g of gelating of sodium dodecylbenzenesulfonate; a red-sensitive silver halide emulsion layer (AgI 2 mol % and AgBr 98 mol %, 3.1 g/m² of Ag) containing 38 g/100 g of silver of 1-hydroxy-2-(N-dodecyl)naphthamide as a cyan color-forming coupler, 0.8 g/100 g of gelatin of 5-hydroxy-7-methyl-1,3,8-triazaindolizine, 0.5 g/100 g of gelatin of 2-hydroxy-4,6-dichloro-S-triazine sodium salt and 3 g/100 g of gelatin of sodium dodecylbenzenesulfonate and spectrally sensitized with 0.3 g/100 g of silver of the following sensitizing dye A; and a green-sensitive silver halide emulsion layer (AgI 3.3 mol % and AgBr 96.7 mol %, 2.2 g/m² of Ag) containing 37 g/100 g of silver of 1-(2,4,6-trichlorophenyl)-3-3-(2,4-di-tert-pentylphenoxyacetamido) benzamido-5-pyrazolone as a magenta color-forming coupler, 0.8 g/100 g of gelatin of 5-hydroxy-7-methyl-1,3,8-triazaindolizine, 0.5 g/100 g of gelatin of 2-hydroxy-4,6-dichloro-S-triazine sodium salt and 3 g/100 g of gelatin of sodium dodecylbenzenesulfonete and spectrally sensitized with 0.3 g/100 g of silver of the following sensitizing dye B.

Sensitizing Agent A:

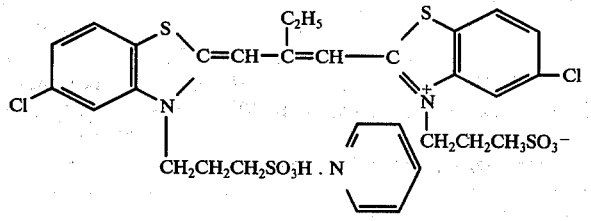

Sensitizing Agent B:

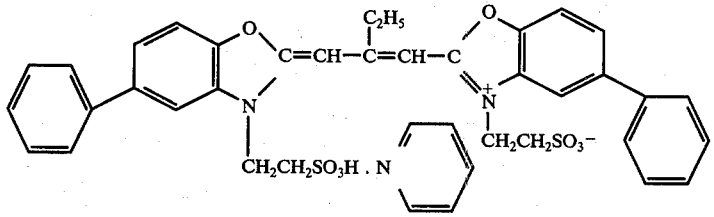

In a photographic material containing as an uppermost layer the synthetic polymer compound according to the present invention, reticulation can be prevented even when the element is exposed to high temperature (more than 35°, in some cases about 60° C), during production or processing of the photographic material. Also, reticulation can be prevented when the material is passed, during processing, through various solutions differing from each other in pH, salt concentration, solution temperature, and the like. Furthermore, there is an advantage that reticulation can be prevented even when the amount of a hardener contained is small.

The present invention will now be illustrated in greater detail by reference to the following non-limiting examples of preferred embodiments of the present invention.

EXAMPLE 1

On a support were provided a blue-sensitive silver halide emulsion layer (AgI 3.3 mol % and AgBr 96.7

Then coating solutions having the following compositions were applied thereto as an uppermost layer to prepare light-sensitive materials (all % are wt. % unless otherwise indicated).

Coating Solution 1 for the uppermost layer:

A 8% gelatin queous solution containing as a hardener 5 mg of 2-hydroxy-4,6-dichloro-S-triazine sodium salt per 1 g of dry gelatin.

Coating Solution 2 for the uppermost layer:

A 5% gelatin aqueous solution containing as a hardener 10 mg of 1,3-propanediol glycidyl ether per 1 g of dry gelatin.

Coating Solution 3 for the uppermost layer:

A 5% gelatin aqueous solution containing as a hardener 10 mg of 2,4,6-triethyleneimino-S-triazine per 1 g of dry gelatin.

Coating Solution 4 for the uppermost layer:

A 10% gelatin aqueous solution containing no hardener.

Coating Solution 5 for the uppermost layer:

A 8% water-methanol (1:1 in volume ratio) solution of Polymer 9 of the present invention.

Coating Solution 6 for the uppermost layer:

A 1% sodium carbonate aqueous solution containing 5% of Polymer 9 of the present invention.

Coating Solution 7 for the uppermost layer:

A 5% water-methanol (1:1 in volume ratio) solution of Polymer 9, containing as a hardener 5 mg of 2-hydroxy-4,6-dichloro-s-triazine sodium salt per 1 g of Polymer 9 of the present invention.

Coating Solution 8 for the uppermost layer:

A 1% sodium carbonate aqueous solution containing 5% of Polymer 9, containing as a hardener 5 mg of 2-hydroxy-4,6-dichloro-s-triazine sodium salt per 1 g of Polymer 9 of the present invention.

Coating solution 9 for the uppermost layer:

A 5% methanol solution of Polymer 11.

The dry film thickness of the uppermost layer in each instance was 1.5μ. These color photographic light-sensitive materials were processed according to the following steps and the degree of reticulation was determined. The results thus obtained are shown in Table 1.

| Processing Step | Temperature | Time |
|---|---|---|
| Color Development | 38° C | 3 min. |
| Washing | 38° C | 15 sec. |
| Fix-bleaching | 38° C | 2 min. |
| Washing | 38° C | 2 min. |
| Stabilizing | 38° C | 15 sec. |

Table 1

| Coating Solution for Uppermost Layer | Degree of Reticulation |
|---|---|
| 1 | +++ |
| 2 | +++ |
| 3 | +++ |
| 4 | 0 |
| 5 | − |
| 6 | + |
| 7 | − |
| 8 | + |

−: No reticulation observed.
+: Very slight degree of reticulation observed.
++: Slight degree of reticulation observed.
+++: Serious degree of reticulation observed.
0: Uppermost layer delaminated and was washed away during processing.

From the above results, it can be seen that, in using the light-sensitive material as the uppermost layer synthetic high molecular compound in accordance with the present invention in place of gelatin, reticulation can be markedly reduced.

EXAMPLE 2

On a support were provided a red-sensitive silver halide emulsion layer containing a cyan color-forming coupler, a green-sensitive silver halide emulsion layer containing a magenta color-forming coupler and a blue-sensitive silver halide emulsion layer containing a yellow color-forming coupler, these layers all being as described in Example 1. Then, the following coating solutions (1) to (6) were applied thereto as an uppermost layer to prepare light-sensitive materials.

Coating Solution (1):

A 5% gelatin aqueous solution containing 0.5 g/100 g of gelatin of 2-hydroxy-4,6-dichloro-s-triazine sodium salt and 10 g/100 g of gelatin of colloidal silica.

Coating Solution (2):

A 5% gelatin aqueous solution containing 10 g/100 g of gelatin of colloidal silica.

Coating Solution (3):

A 7% aqueous solution of Polymer 1 of the present invention, containing 10 g/100 g of Polymer 1 of colloidal silica.

Coating Solution (4):

A 1% aqueous solution of Polymer 4 of the present invention, containing 10 g/100 g of Polymer 4 of colloidal silica.

Coating Solution (5):

A 5% water-methanol (1:1 in volume ratio) solution of Polymer 5 of the present invention, containing 10 g/100 g of Polymer 5 of colloidal silica.

Coating Solution (6 ):

A 12% water-methanol (1:1 in volume ratio) solution of Polymer 7 of the present invention, containing 10 g/100 g of Polymer 7 of colloidal silica.

The uppermost layers had a dry thickness of 2μ in each instance. These color photographic light-sensitive materials were subjected to color development processing at 40° C for 2 minutes and 30 seconds. The degree of reticulation was rated in the same manner as described in Example 1. The results thus obtained are shown in Table 2.

Table 2

| Coating Solution | Degree of Reticulation |
|---|---|
| 1 | +++ |
| 2 | +++ |
| 3 | − |
| 4 | − |
| 5 | + |
| 6 | + |

It can be seen that reticulation can be markedly reduced by using as the uppermost layer the synthetic polymer compound of the present invention in place of gelatin.

EXAMPLE 3

Color photographic light-sensitive materials as described in Example 1 were process according to the following steps, and the degree of reticulation was rated in the similar manner. The results thus obtained are shown in Table 3.

| Processing Step | Temperature | Time |
|---|---|---|
| Color Development | 52° C | 1 min and 30 sec. |
| Stopping | 52° C | 40 sec. |
| Fixing | 52° C | 1 min. |
| Bleach-fixing | 52° C | 1 min and 30 sec. |
| Washing | 52° C | 2 min and 30 sec. |
| Stabilizing | 52° C | 10 sec. |

Table 3

| Coating Solution for Uppermost Layer | Degree of Reticulation |
|---|---|
| 1 | +++ |
| 2 | 0 |
| 3 | +++ |
| 4 | 0 |
| 5 | + |
| 6 | + |
| 7 | + |
| 8 | + |

It can be seen that reticulation can be markedly reduced by using as the uppermost layer the synthetic polymer compound of the present invention in place of gelatin.

EXAMPLE 4

In the same manner as described in Example 1, a blue-sensitive silver halide emulsion layer, a red-sensitive silver halide emulsion layer and a green-sennsitive silver halide emulsion layer were provided on a support, and a gelatin layer containing as a hardener 5 mg of 2-hydroxy-4,6-dichloro-s-triazine sodium salt per 1 g of dry gelatin was provided on the green-sensitive layer. Furthermore, coating solution (1) to (6) having the following compositions were applied thereto as the uppermost layer to prepare light-sensitive materials.

Coating Solution (1):

A 6% aqueous solution of Polymer 2 of the present invention.

Coating Solution (2):

A 4% aqueous solution containing Polymer 4 and 8 of the present invention in a volume ratio of 1:1.

Coating Solution (3):

A 15% water-methanol (1:1 in volume ratio) solution containing Polymer 8 and 9 of the present invention in a volume ratio of 1:1.

Coating Solution (4):

A 3% water-methanol (1:1 in volume ratio) solution of Polymer 9 of the present invention.

Coating Solution (5):

A 5% water-methanol (1:1 in volume ratio) solution of Polymer 8 of the present invention.

Coating Solution (6):

Water (for the purpose of comparison)

Coating Solution (7):

Water-methanol (1:1 in volume ratio) (for the purposes of comparison).

The resulting uppermost layers of the polymers of the present invention each had a dry thickness of 1.2μ. These photographic light-sensitive materials were processed as described in Example 1 and the degree of reticulation was rated in the same manner as described in Example 1. The thus obtained results are shown in Table 4.

Table 4

| Coating Solution | Degree of Reticulation |
|---|---|
| 1 | – |
| 2 | – |
| 3 | – |
| 4 | + |
| 5 | +++ |
| 6 | +++ |

It can be seen that reticulation can be remarkably reduced by using as the uppermost layer the synthetic polymer compound of the present invention, and that reticulation cannot be prevented by using water or water-methanol alone.

EXAMPLE 5

Photographic materials were obtained in a manner similar to Example 1 except for using the following coating solutions instead of the coating solutions of Example 1.

Coating Solution (1)

A 5% gelatin aqueous solution containing 5 mg of the sodium salt of 2-hydroxy-4,6-dichloro-S-triazine per 1 g of dry gelatin as a hardener.

Coating Solution (2)

A 5% water-methanol (1:1 in volume ratio) solution of Polymer 9 containing 5 mg of the sodium salt of 2-hydroxy-4,6-dichloro-S-triazine per 1 g of Polymer 9 as a hardener.

Coating Solution (3)

A mixture of coating Solution (1) and coating Solution (2), in which the weight ratio of gelatin and Polymer 9 is 2:8.

These photographic materials were processed in the same manner as described in Example 1 and the degree of reticulation was rated in the same manner as described in Example 1. The results obtained are shown in Table 5.

Table 5

| Coating Solution | Degree of Reticulation |
|---|---|
| 1 | +++ |
| 2 | – |
| 3 | +++ |

It can be seen from the results shown in Table 5 that the film forming component in the composition of the uppermost layer of the present invention should substantially consist of the organic synthetic high polymer of the present invention.

While the invention has been in detail and with reference to specific embodiments thereof, it will be apparent to one skilled in the art that various changes and modifications can be made therein without departing from the spirit and scope thereof.

What is claimed is:

1. A photographic silver halide light-sensitive element including a support a light sensitive silver halide layer and, a non-light sensitive uppermost layer said uppermost layer not containing gelatin, not delaminating from said light-sensitive material when subjected to a processing solution selected from the group consisting of a developing solution, water, a fix-bleaching solution, a stopping solution, a fixing solution and a stabilizing solution and comprising polymer (F) comprising repeating unit $f_1$ $f_1$:

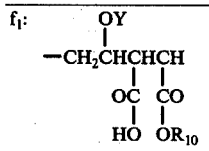

wherein Y represents $—CH_3$ or $—COCH_3$, $R_{10}$ represents —H or $—C_nH_{2n+1}$, $n$ being an integer of 1 to 12, and at least one unexposed silver halide light-sensitive layer between said support and said uppermost layer, said polymer (F) being insoluble in any of said processing solutions used during processing, and the thickness of said layer being sufficient to prevent reticulation.

2. The photographic light-sensitive material of claim 1, wherein the thickness of said uppermost layer ranges from about 0.5 to 3 microns.

3. The photographic light-sensitive material of claim 1, wherein said uppermost layer consists of Polymer (F).

4. The photographic light-sensitive material of claim 1 wherein said uppermost layer contains at least one of a hardener, an adhesion-preventing agent, an anti-slip agent, a slip agent, an anti-static agent, a coating aid or a matting agent.

5. The light sensitive material of claim 1, wherein said polymer (F) is in mixture with at least one polymer selected from the group consisting of the following polymers (A) to (E)

polymer (A) comprising repeating units $a_1$ and $a_2$;

| | | |
|---|---|---|
| $a_1$: | $-CH_2CH-$ <br> OH | 80 - 97 mol% |
| $a_2$: | $-CH_2CH-$ <br> $O(CH_2)_mSO_3M$ | 3 - 20 mol% |

wherein M represents a cation, and $m$ represents 0, 3 or 4;

polymer (B) comprising repeating units $b_1$, $b_2$ and $b_3$;

| | | |
|---|---|---|
| $b_1$: | $-CH_2CH-$ <br> $CON(R_1)(R_2)$ | 5 - 30 mol% |
| $b_2$: | $-CH_2C(R_3)-$ <br> $COOR_4$ | 5 - 75 mol% |
| $b_3$: | $-CH_2C(R_5)-$ <br> $CONH_2$ | 20 - 65 mol% |

wherein $R_1$ and $R_2$ each represents $-CH_3$ or $-C_2H_5$, $R_3$ and $R_5$ each represents —H or $-CH_3$, and $R_4$ represents $-Ch_3$, $-C_2H_5$, $-C_3H_5$ or $-C_4H_9$;

polymer (C) comprising repeating units $c_1$ and $c_2$;

| | | |
|---|---|---|
| $c_1$: | $-CH_2CH-$ <br> CO <br> NH <br> $CH_3-C-CH_3$ <br> $CH_2$ <br> CHOH <br> $CH_3$ | 10 - 40 mol% |
| $c_2$: | $-CH_2C(R_6)-$ <br> Z | 60 - 90 mol% |

wherein $R_6$ represents —H or $-CH_3$, and Z represents $-COOH$, $-COOCH_3$, $-COOC_2H_5$, $-COOC_3H_7$, $-COOC_4H_9$ or $-CONH_2$;

polymer (D) comprising repeating units $d_1$ and $d_2$;

| | | |
|---|---|---|
| $d_1$: | $-CH_2CH-$ <br> CO <br> NH <br> $CH_3-C-CH_3$ <br> $CH_2$ <br> CO <br> $CH_3$ | 10 - 40 mol% |

-continued

| | | |
|---|---|---|
| $d_2$: | $-CH_2C(R_7)-$ <br> $CONH_2$ | 60 - 90 mol% |

wherein $R_7$ represents —H or $-CH_3$;

polymer (E) comprising repeating units $e_1$ and $e_2$;

| | | |
|---|---|---|
| $e_1$: | $-CH_2C(R_8)-$ <br> COOX | 20 - 60 mol% |
| $e_2$: | $-CH_2C(R_9)-$ <br> COOH | 40 - 80 mol% |

wherein $R_8$ and $R_9$ each represents —H or $-CH_3$, and X represents $-CH_3$, $-C_2H_5$, $-C_3H_7$ or $C_4H_9$.

6. A method of preventing reticulation of a photographic silver halide light-sensitive element containing an unexposed silver halide light-sensitive layer, which method comprises coating on said photographic light-sensitive element as the uppermost layer of said photographic light-sensitive material a layer not containing gelatin and comprising an organic synthetic high molecular weight polymer (F) comprising repeating unit $f_1$

| | |
|---|---|
| $f_1$: | $-CH_2CH(OY)CH(OC(=O)HO)CH(CO)OR_{10}$ |

wherein Y represents $-CH_3$ or $-COCH_3$, $R_{10}$ represents —H or $-C_nH_{2n+1}$, $n$ being an integer of 1 to 12, at least one unexposed silver halide light sensitive layer being between said support and said uppermost layer, said uppermost layer not delaminating from said light-sensitive material when subjected to a processing solution selected from the group consisting of a developing solution, water, a fix-bleaching solution, a stopping solution, a fixing solution and a stabilizing solution, said organic synthetic polymer being insoluble in any of said processing solutions used during processing, and the thickness of said layer being sufficient to prevent reticulation.

7. The method of preventing reticulation of claim 6, wherein the thickness of said uppermost layer ranges from about 0.5 to 3 microns.

8. The method of preventing reticulation of claim 6, wherein said uppermost layer consists of Polymer (F).

9. The method of claim 6 wherein said uppermost layer contains at least one of a hardener, an adhesion-preventing agent, an anti-slip agent, a slip agent, an anti static agent, a coating aid or a matting agent.

10. The method of claim 6 wherein polymer (F) is in mixture with at least one polymer selected from the group consisting of organic synthetic polymer compounds selected from the group consisting of polymers(A) (B), (C), (D) and (E)

polymer (A) comprising repeating units $a_1$ and $a_2$;

| | |
|---|---|
| $a_1$: $-CH_2CH(OH)-$ | 80 - 97 mol% |
| $a_2$: $-CH_2CH(O(CH_2)_mSO_3M)-$ | 3 - 20 mol% |

wherein M represents a cation, and $m$ represents 0, 3 or 4;

polymer (B) comprising repeating units $b_1$, $b_2$ and $b_3$;

| | |
|---|---|
| $b_1$: $-CH_2CH(CON(R_1)(R_2))-$ | 5 - 30 mol% |
| $b_2$: $-CH_2C(R_3)(COOR_4)-$ | 5 - 75 mol% |
| $b_3$: $-CH_2C(R_5)(CONH_2)-$ | 20 - 65 mol% |

wherein $R_1$ and $R_2$ each represents $-CH_3$ or $-C_2H_5$, $R_3$ and $R_5$ each represents —H or $-CH_3$, and $R_4$ represents $-CH_3$, $-C_2H_5$, $-C_3H_5$ or $-C_4H_9$;

polymer (C) comprising repeating units $c_1$ and $c_2$;

| | |
|---|---|
| $c_1$: $-CH_2CH(CO-NH-C(CH_3)_2-CH_2-CHOH-CH_3)-$ | 10 - 40 mol% |
| $c_2$: $-CH_2C(R_6)(Z)-$ | 60 - 90 mol% |

wherein $R_6$ represents —H or $-CH_3$, and Z represents —COOH, $-COOCH_3$, $-COOC_2H_5$, $-COOC_3H_7$, $-COOC_4H_9$ or $-CONH_2$;

polymer (D) comprising repeating units $d_1$ and $d_2$;

| | |
|---|---|
| $d_1$: $-CH_2CH(CO-NH-C(CH_3)_2-CH_2-CO-CH_3)-$ | 10 - 40 mol% |
| $d_2$: $-CH_2C(R_7)(CONH_2)-$ | 60 - 90 mol% |

wherein $R_7$ represents —H or $-CH_3$;

polymer (E) comprising repeating units $e_1$ and $e_2$;

| | |
|---|---|
| $e_1$: $-CH_2C(R_8)(COOX)-$ | 20 - 60 mol% |
| $e_2$: $-CH_2C(R_9)(COOH)-$ | 40 - 80 mol% |

wherein $R_8$ and $R_9$ each represents —H or $-CH_3$, and X represents $-CH_3$, $-C_2H_5$, $-C_3H_7$ or $C_4H_9$.

* * * * *